United States Patent [19]

Osabe

[11] Patent Number: 4,719,762

[45] Date of Patent: Jan. 19, 1988

[54] STORED ICE DETECTING DEVICE IN ICE MAKING APPARATUS

[75] Inventor: Kenichi Osabe, Kamo, Japan

[73] Assignee: Toshiba Heating Appliances Co., Ltd., Japan

[21] Appl. No.: 931,858

[22] Filed: Nov. 18, 1986

[30] Foreign Application Priority Data

Nov. 21, 1985 [JP] Japan ..... 60-179509[U]
Aug. 13, 1986 [JP] Japan ..... 61-124800[U]

[51] Int. Cl.[4] ..... F25C 1/10

[52] U.S. Cl. ..... 62/137; 200/61.2; 340/612; 403/119

[58] Field of Search ..... 62/137, 344; 200/61.2, 200/61.21; 340/612, 617; 403/119

[56] References Cited

U.S. PATENT DOCUMENTS 2,717,497 9/1955 Knerr ..... 62/137
3,180,105 4/1965 Frohbieter ..... 62/137
3,407,619 10/1968 Walker ..... 62/137
3,863,461 2/1975 Bright ..... 62/137
4,332,146 6/1982 Yamazaki et al. ..... 62/353
4,492,017 1/1985 Latter ..... 62/137 X

*Primary Examiner*—William E. Tapolcai
*Attorney, Agent, or Firm*—Steele, Gould & Fried

[57] ABSTRACT

An automatic ice making apparatus for freezing ice making water into ice having the shape of a cube or the like and storing the ice in an ice bank, in which the quantity of the ice stored in the ice bank is detected by a stored ice detecting device, and when the stored ice quantity is small or zero, the ice making operation is continued, while when the stored ice quantity corresponds to a predetermined quantity, the ice making operation is stopped. A stored ice detecting arm is provided replaceably through a joint member in order to attain an easy setting of the above stored ice quantity, that is, an easy adjustment of a detection level for the ice bank.

2 Claims, 10 Drawing Figures

STORED ICE DETECTING DEVICE IN ICE MAKING APPARATUS

BACKGROUND OF THE INVENTION

1. Field of Art

The present invention relates to a stored ice detecting device in an ice making apparatus for detecting whether there is present ice in the form of cubes or the like which have been fed to and stored in an ice bank from a body of the ice making apparatus for making ice from ice making water.

2. Prior Art

Automatic ice making apparatus have been used in places where ice is consumed in large quantities such as restaurants, hotels and bars, as well as in homes. As an example of this type of an ice making apparatus there is known the automatic ice-making machine of U.S. Pat. No. 4,332,146 entitled "Drive Force Transmitting Device for Ice-Making Tray of Automatic Ice-Making Machine". This ice-making machine is provided with an ice-making tray disposed above an ice bank and adapted to be turned over from an upward ice-making condition to release ice and then turned back by mean of a motor, and a stored ice detecting arm which is rotated interlockedly with the ice-making tray by means of the said motor and which detects whether ice is present in the ice bank.

These elements, namely the ice-making tray, ice bank and stored ice detecting arm, are disposed in a freeze storing chamber provided with an ice removal door. Where a predetermined quantity of ice is stored in the ice bank, the stored ice detecting arm comes into abutment with pieces of ice and detects this full condition.

On the other hand, where the ice bank contains only a small quantity of ice or is empty after consumption of ice therein, the stored ice detecting arm goes down to its lower limit and can detect such low condition.

Also known is the ice-making apparatus of U.S. Pat. No. 3,545,217 entitled "Sensing Arm Mechanism for Ice Maker". In this ice making apparatus, an ice bank is provided in a door of a freezer and storing chamber, and a stored ice detecting arm for detecting ice stored in the ice bank is provided on the side of the freezer and storing chamber.

Other than the utilization of the above ice -making tray, there is also known an auger type ice making apparatus in which an evaporator constituting a refrigerating system is wound round an outer peripheral surface of a cylinder and then surrounded with a heat insulating material to thereby constitute a cooling cylinder; ice making water is introduced into the cooling cylinder through a water supply line connected to a lower part of the cylinder; and a thin ice layer formed on an inner peripheral wall surface of the cooling cylinder is scraped off and conveyed into the ice bank by means of a spiral rotary blade.

The conventional stored ice detecting arms are constituted integrally by a linear body or the like and they all detect stored ice at a predetermined certain detection level in the ice bank, so the quantity of ice to be detected cannot be adjusted easily. For adjusting the quantity of stored ice to be detected, it is necessary to disassemble a base frame of the ice making apparatus body having the stored ice detecting arm attached thereto at every change of detection level and change the detecting arm as a whole as required for a new detection level.

The present invention has been accomplished in view of the above-mentioned problems, and it is the object thereof to provide a stored ice detecting device in an ice making apparatus capable of easily changing and adjusting the stored ice detection level for an ice bank.

SUMMARY OF THE INVENTION

According to a first invention, in an ice making apparatus in which ice making water is frozen by a body of the ice making apparatus, wherein the ice thus formed is fed to an ice bank and the level of the ice stored in the ice bank is detected by a stored ice detecting device having a stored ice detecting arm for detecting whether ice is present or not, the stored ice detecting arm is connected replaceably through a joint to an arm lift member which is attached rotatably to a base frame.

According to a second invention, in an ice making apparatus in which ice making water is frozen by a body of the ice making apparatus, wherein the ice thus formed is fed to an ice bank and the level of the ice stored in the ice bank is detected by a stored ice detecting device, the stored ice detecting device has plurally divided stored ice detecting arms which are connected together replaceably through a joint member.

BRIEF DESCRIPTION OF THE DRAWINGS

FIGS. 1 to 6 illustrate an embodiment of the first invention, of which:

FIG. 1 is a longitudinal sectional view;

FIG. 2 is a rear view;

FIG. 3 is a perspective view;

FIG. 4 is an exploded perspective view of a stored ice detecting device;

FIG. 5 is a partially cut-away front view of a principal portion, and

FIG. 6 is a bottom view showing a disassembled state.

FIGS. 7 to 9 illustrate an embodiment of the second invention, of which;

FIG. 7 is a partially cut-away front view;

FIG. 8 is a sectional view of a joint member, and showing a connected state of stored ice detecting arms; and FIG. 9 is a sectional view of a second detecting arm connection.

DESCRIPTION OF PREFERRED EMBODIMENTS

Figure 1:
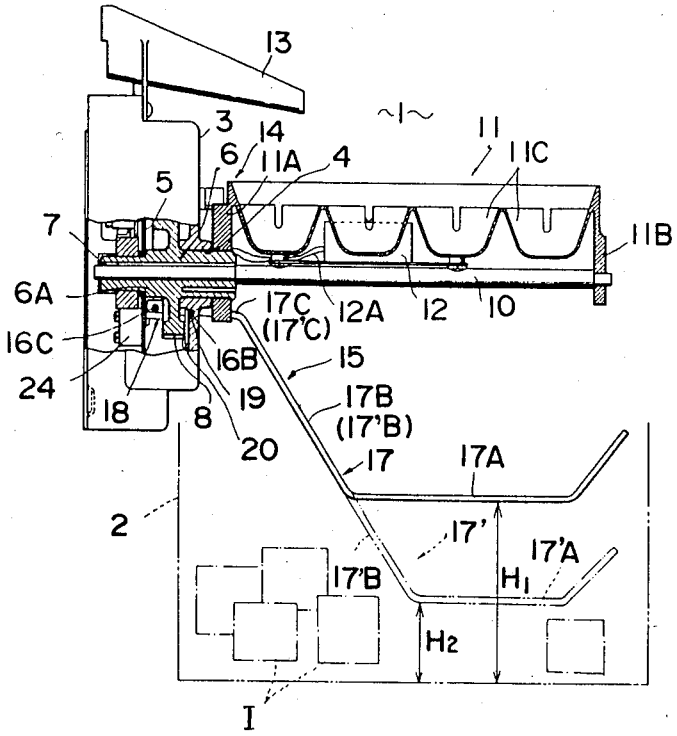
Figure 2:
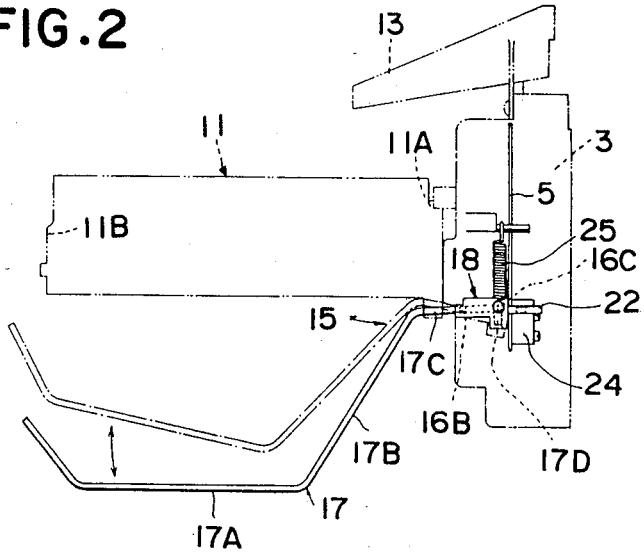
Figure 3:
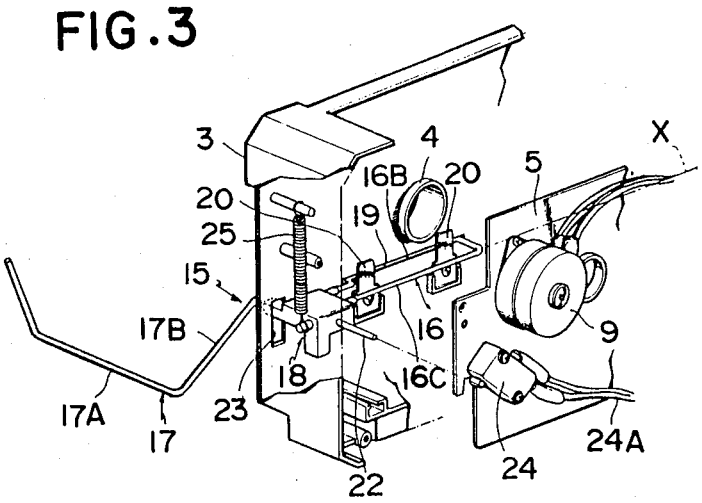
Figure 4:
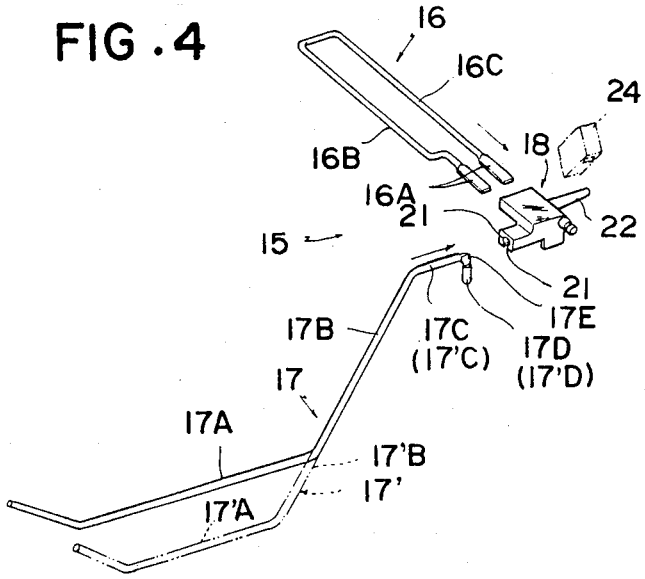
Figure 5:
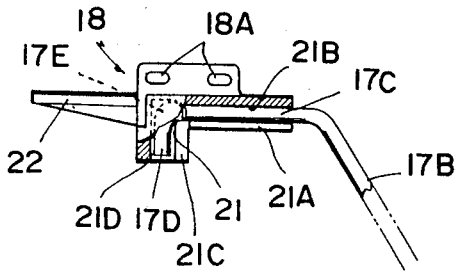
Figure 6:
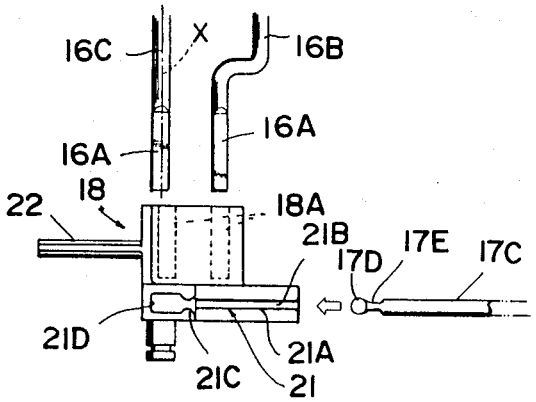

Referring first to FIGS. 1 to 6, there is illustrated an embodiment of the first invention, in which an ice bin or bank 2 is provided below a freeze storing chamber 1 which is surrounded with a heat insulating material (not shown) and into which is fed cold air by means of a fan (not shown). On one side of the freezer and storing chamber 1, a door (not shown) for taking out ice from the ice bank 2 is provided for opening and closing. A bearing sleeve 4 is provided in an outer wall of a base frame 3 which is disposed above one side of the ice bank 2, and a support plate 5 is provided inside the base frame 3. A cylindrical rotating member 6 is supported rotatably between the bearing sleeve 4 and the support plate 5, the rotating member 6 having a central through hole 7. Further, a gear 8 is formed on an outer periphery of the rotating member 6, and a motor 9 provided inside the base frame 3 is connected to the gear 8 through a gear interlock mechanism, whereby the rotating member 6 is turned forward and reversed by a predetermined angle. A shaft 10 is inserted through the through hole 7 of the rotating member 6, and a base end 11A of an ice making tray 11 is engaged with the shaft 10 and a fore end 11B thereof is fitted on the shaft rotatably. The ice making tray 11 is integrally formed of a synthetic resin and it is provided with a plurality of ice making concavities 11C each having an upper opening and depending side by side. An ice sensor 12 is in abutment with a lower surface of the ice making tray, and a lead wire 12A of the ice sensor 12 is connected to a control section (not shown). Provided above the ice making tray 11 is a water supply passage 13 for supplying ice making water precooled in a refrigerating chamber (not shown) to the ice making tray 11. The freezer and storing chamber 1, motor 9, ice making tray 11 and water supply passage 13 function to ice the ice making water supplied and they constitute an ice making apparatus body 14 which drops ice cubes or cakes into the ice bank 2.

Numeral 15 denotes a stored ice detecting device comprising arm lift member 16, a detecting arm 17 and a joint member 18, which are integrally connected together.

The arm lift member 16 is formed from steel or a synthetic resin, and fore ends thereof are formed as flat, retaining portions 16A. One long side portion 16B is disposed in a horizontal groove 19 formed in an inner surface of the base frame 3, and an opposite long side portion 16C is provided vertically rotatably so that it can abut a cam portion 6A integral with the rotating member 6, with holding plates 20 disposed outside. That is, with rotation of the cam portion 6A, the opposite long side portion 16C moves up and down with the one long side portion 16B as the center. The stored ice detecting arm 17 is a linear member formed of steel or a synthetic resin, and it comprises a detecting portion 17A, a slant portion 17B extending from one end of the detecting portion, a short horizontal portion 17C contiguous to the slant portion, and a hook portion 17D extending downward from an end of the short horizontal portion. And a flat retaining portion 17E is formed in the connection between the hook portion 17D and the short horizontal portion 17C. A joint member indicated by numeral 18 is formed with a pair of retaining holes 18A as a first fitting portion for insertion therein of the retaining portions 16A of the arm lift member 16, while a slot 21 as a second fitting portion for insertion therein of the stored ice detecting arm 17 is formed in the joint member 18 on the side of the base frame 3 perpendicularly to an axis X. Further, an actuating portion 22 is provided projectingly from the joint member 18 perpendicularly to the axis X in a direction opposite to the fitting slot 21. The slot 21 is formed in an inverted L shape comprising a transverse slot portion 21B having a lower narrow opening 21A and a vertical slot portion 21D connected to the transverse slot portion and having an inside narrow opening 21C. A window hole 23 is formed in the base frame 3 in a position opposed to a fore end of the transverse slot portion 21B, and an operating switch 24 is attached to the support plate 5 in a position close to the actuating portion 22. Lead wire 24A from the operating switch 24 is connected to the above control section. Numeral 25 denotes a spring for returning motion of the stored ice detecting device 15.

The following description is now provided as to the operation in the above construction.

The short portion 17C and hook portion 17D of the stored ice detecting arm 17 are inserted from the window hole 23, and the short portion 17C is fitted in the transverse slot portion 21B, while the hook portion 17D is fitted in the vertical slot portion 21D.

Upon freezing of the water in the ice making tray 11 disposed in the freeze storing chamber 1, the ice sensor 12 senses this condition and actuates the motor 9 to rotate the rotating member 6 in one direction. With this rotation of the rotating member 6, the ice making tray 11 rotates through the shaft 10 and the fore end 11B of the ice making tray 11 is retained at a certain angle by means of a stopper (not shown). With further rotation of the ice making tray 11, the tray is twisted and so ice cubes or cakes I on the ice making concavities 11C are brought into a somewhat floating state, and upon reversal of the tray 11, the ice cakes I are thrown into the ice bank 2.

Then, the rotating member 6 is turned in a reverse direction and the ice making tray 11 is thereby returned to its horizontal state, whereupon precooled ice making water is fed from the water supply passage 13 into the ice making concaves 11C and the ice making operation is performed again.

And interlockedly with the rotation of the ice making tray 11 the stored ice detecting device 15 is driven up and down in accordance with the rotation of the cam portion 6A, thereby detecting an ice storage condition to control the reversal of the ice making tray 11. More specifically, when the quantity of the ice cakes I in the ice bank 2 is small, the detecting portion 17A of the stored ice detecting arm 17 goes down to its lower limit position, whereupon the joint member 18 is urged in a counterclockwise direction by the return spring 25 with one long side portion 16B of the arm lift member 16 made as a rotational center, resulting in that the actuating portion 22 pushes the operating switch 24 to control the control section to continue the ice making operation. On the other hand, when the quantity of ice cakes I in the ice bank 2 reaches a predetermined level, the detecting portion 17A of the stored ice detecting arm 17 comes into abutment with the ice cakes I so that its downward movement is restricted. Therefore, the actuating portion 22 of the joint member 18 does not abut the operating switch 24 and control is made by the control section so that the ice making tray 11 is not turned over even upon completion of freezing thereon.

Further, as the ice cakes I in the ice bank 2 is consumed, the detecting portion 17A of the stored ice detecting arm 17 goes down and the actuating portion 22 comes into abutment with the operating switch 24, resulting in that the rotation of the shaft 10 and the succeeding operations are repeated by the control section.

For lowering the detection level for the quantity of ice stored in the ice bank 2, that is, for reducing the storage quantity of ice, the stored ice detecting arm 17 is drawn out from the joint member 18 and then a short horizontal portion 17'C and a hook portion 17'D of a stored ice detecting arm 17' which has a longer slant portion 17'B and a detecting portion 17'A are fitted in the transverse slot portion 21B and the vertical slot portion 21D of the joint member 18. Thus, the stored ice detecting arms 17 and 17' having the respective detecting portions 17A and 17'A in positions different from each other are disposed selectively in the joint member 18 detachably and replaceably with respect to the arm lift member 16 at the time of setting a detection level, whereby a plurality of detection levels $H_1$ and $H_2$ can be obtained.

Thus, the stored ice detecting device 15 to which the operating switch 24 is responsive is constituted by the arm lift member 16 disposed inside the base frame 3 rotatably, the joint member 18 having the retaining holes for the arm lift member 16 and also having the fitting slot 21, and the stored ice detecting arm 17 fitted in the slot 21 at one end thereof and having the detecting portion 17A. This construction permits easy replacement and adjustment of the stored ice detecting arms 17 and 17' selectively according to plural detection levels $H_1$ and $H_2$.

Further, since the stored ice detecting arm 17 is provided in an orthogonal direction with respect to the arm lift member 16, the arm can be disposed below the ice making tray 11. Moreover, since the joint member 18 is provided with not only the retaining holes 18A for insertion therein of the arm lift member 18 but also the slot 21 for fitting therein of the stored ice detecting arm 17, the arm lift member 16 and the stored ice detecting arm 17 can be made integral with the joint member 18 by a simple operation of their insertion in the joint member. Besides, since one long side portion 16B of the arm lift member 16 is attached to the base frame 3 while the other long side portion 16C is made displaceable, the long side portion 16C responds to the rotation of the cam portion 6A whereby the stored ice detecting arm 17 can be moved up and down.

Additionally, in mounting the stored ice detecting arm 17 to the joint member 18, since the retaining portion 17E is formed between the short horizontal portion 17C and the hook portion 17D of the stored ice detecting arm 17 and the arm 17 is fixed through the fitting slot 21 having narrow openings 21A and 21C, it is possible to prevent the detecting arm 17 from moving in other directions than the vertical direction, thus ensuring an exact operation. Further, also in the arm lift member 16 and the joint member 18, the other movements of the former than the movement around one long side portion 16B are prevented by the flat retaining holes 18A and the retaining portions 16A, thus ensuring an accurate operation.

Figure 7:
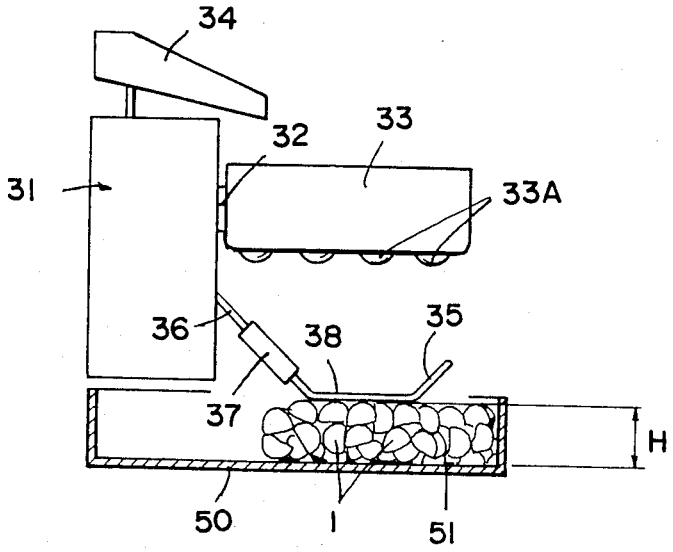
Figure 8:
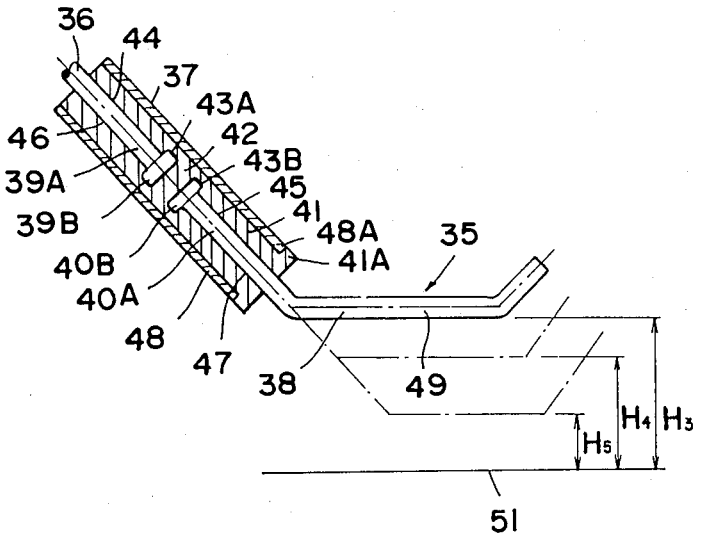
Figure 9:
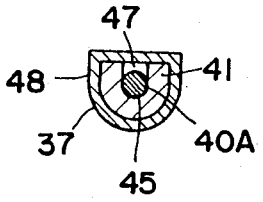

Referring now to FIGS. 7 to 9, there is illustrated an embodiment of the second invention, in which the numeral 31 illustrates an ice making apparatus body which supports an ice making tray 33 horizontally and rotatably through a shaft 32. The ice making tray 33 has a plurality of ice making concavities 33A having upper openings and disposed side by side. To the lower surfaces of the ice making concavities 33A is attached an ice sensor (not shown) constituted by a thermostat, and an ice making water supply passage 34 is provided above the ice making tray 33.

Further, a base portion of a stored ice detecting arm 35 is attached to the ice making apparatus body 31 and is vertically movable. The stored ice detecting arm 35 is constituted by a first rod-like detecting arm 36 having a base end portion attached to the ice making apparatus body 31 and a second detecting arm 38 connected to a force end portion of the first detecting arm 36 detachably and replaceably through a joint member 37. A mounting portion 39A at the fore end of the first detecting arm 36 and a mounting portion 40A of the second detecting arm 38 have retaining portions 39B and 40B formed integrally in a flat square shape for preventing the arms from swivelling and falling off. Like the above embodiment of the first invention, an arm lift member (not shown) is provided integrally with the first detecting arm 36.

The joint member 37 has a joint body 41 of a generally semicircular section, and on a longitudinal axis of the joint body 41 there is formed a partition wall 42 as an intermediate portion. With the partition wall 42 as a boundary, there are formed accommodating portions 46 and 47 comprising retaining recesses 43A and 43B for insertion therein of the retaining portions 39B and 40B on the side of the partition wall 42 and slots 44 and 45 for insertion therein of the mounting portions 39A and 40A, the slots 44 and 45 extending contiguously to the retaining recesses 43A and 43B up the both end portions of the joint body. Moreover, a cover 48 is slidably mounted on the joint body 41 to cover the whole of the outer periphery of the joint body, and an opening edge 48A at one end of the cover 48 is retained by a retaining stepped portion 41A of the joint body 41. The second detecting arm 38 has a detecting portion 49 extending outwards horizontally through a bent portion from the mounting portion 40A.

Further, an ice bank 50 is provided below the ice making tray 33, and a detection level H of a predetermined distance for detecting the quantity of ice cubes or cakes I in the ice bank 50 is set between the stored ice detecting arm 35 and the detecting portion 49.

The ice making tray 33 is rotated by a drive unit having a motor, and the stored ice detecting arm 35 is moved by the said drive unit at the time going in one direction (upward) and moved by virtue of a spring at the time of return in an opposite direction (downward).

The following is an explanation of the operation.

First, the cover 48 of the joint member 37 is fitted over the first detecting arm 36, and the mounting portion 39A and retaining portion 39B of the first detecting arm 36 fitted in one accommodating portion of the joint body 41, while the mounting portion 40A and retaining portion 40B of the second detecting arm 38 are fitted in the other accommodating portion 47. Then, the cover 48 is slid on the joint body 41 until its opening edge 48A is retained by the retaining stepped portion 41A. As a result, the retaining portions 39B and 40B of the first and second detecting arms 36 and 38 are fitted in the retaining recesses 43A and 43B of the joint body 41 whereby they are prevented from swivelling and falling off and are connected contiguously to each other. This state is maintained by the cover 48, and the detecting portion 49 of the second detecting arm 38 is opposed to the ice making tray 33 at the predetermined detection level H.

Next, in the freeze storing chamber, upon freezing of the water in the ice making concavities 33A of the ice making tray 33, the ice sensor detects this condition and actuates the drive unit, so that the ice making tray 33 rotates in one direction together with the shaft 32. At the same time, the stored ice detecting arm 35 is moved upward to stand out of the way of the ice making tray 33.

After ice making, the stored ice detecting arm 35 goes down as the ice making tray 33 turns back. In this case, if the ice cakes I are stored up to the detection level H in the ice bank 50, the detecting portion 49 of the stored ice detecting arm 35 comes into abutment with the ice cakes I and its downward movement is thereby restricted, so that the ice making tray 33 is not turned over even when the next freezing of the water in the tray 33 is completed.

In the case of changing the detection level H for the quantity of ice stored in the ice bank 50, the cover 48 of the joint member 37 is slid toward the first detecting arm 36 until when its opening edge 48A is positioned at least on the partition wall 42, whereby the upper part of the accommodating portion 47 of the joint body 41 is opened. Then, the mounting portion 40A and retaining portion 40B of the second detecting arm 38 fitted in the accommodating portion 47 are taken out from the latter.

Thereafter, in place of the second detecting arm 38 thus taken out from the joint member 37, another detecting arm capable of setting a detection level H different from the previous detection level H is newly selected as the second detection arm 38, then the mounting portion 40A and retaining portion 40B of the thus -selected second detecting arm 38 are fitted in the retaining recess 43B and slot 45 of the joint body 41.

Next, the cover 48 is slid on the joint body 41 toward the second detecting arm 38 until its opening edge 48A comes into engagement with the retaining stepped portion 41A, whereby the newly selected second detecting arm 38 is fitted in the joint body 37 and a new detection level H is set by the detecting portion 49 of the arm 38.

Thus, a plurality of detecting arms having detecting portions 49 in positions different from each other are selectively connected to the first detecting arm 36 through the joint member 37 detachably and replaceably at the time of setting of a detection level, whereby plural detection levels, for example, $H_3$, $H_4$ and $H_5$ can be obtained as shown in FIG. 8.

Besides, the replacement of the second detecting arm 38 can be done easily by merely sliding the cover 48 with respect to the joint body 41. Moreover, since the second detecting arm 38 alone is replaced with another second detecting arm, it is possible to attain the reduction of cost in comparison with replacing the whole of the stored ice detecting arm 35.

Figure 10:
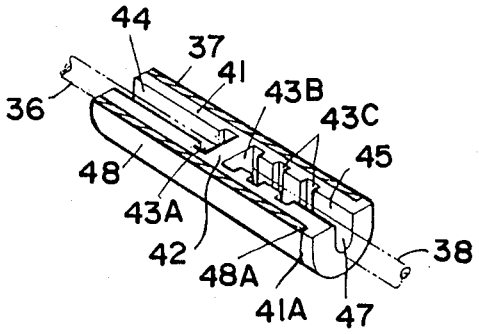
FIG. 10 is a partially cut-away perspective view showing another embodiment of the second invention.

As means for changing the detection level H, although in the above embodiment a plurality of detecting arms having detecting portions 49 in different positions are used selectively as second detecting arms 38 at the time of setting a detection level, the means for changing the detection level H is not limited thereto. For example, a single second detecting arm 38 may be retained in the joint member 37 so that its position can be adjusted in its longitudinal direction to change the detection level H. In this case, a plurality of retaining portions 43 for the retaining portion 40B of the second detecting arm 38 are formed at predetermined intervals in the second detecting arm fitting slot 45 on one side of the joint member 37, as shown in FIG. 10. And the retaining portion 40B of the second detecting arm 38 is selectively fitted in one of plural retaining recesses 43B and 43C of the accommodating portion 47, whereby a desired detection level H for the ice bank 50 can be set easily.

The present invention is not limited to the above embodiments. Various modifications may be made. For example, although the ice making apparatus in the above embodiments utilize an ice making tray, there may be adopted an auger type ice making apparatus as previously explained in connection with the prior art. Further, although in FIGS. 7 to 9 the stored ice detecting arm 35 is divided in two, it may be divided in three or more which are made integral with one another through a joint member.

According to the present invention, as set forth hereinabove, it is possible to easily change and adjust the stored ice detection level for the ice bank.

What is claimed is:

1. A stored ice detecting device for detecting ice stored in an ice bank, in an ice making apparatus having an ice making apparatus body for freezing ice making water into ice and supplying the ice to the ice bank, said stored ice detecting device comprising:

an arm lift member attached rotatably to a base frame, a stored ice detecting arm adapted to come into abuttment with the ice stored in said ice bank to detect whether ice is present or not therein, and a joint member for connecting said arm lift member and said stored ice detecting arm integrally replaceably and transmitting movements of the arm lift member to the detecting arm, said arm lift member having a pair of parallel long side portions, one long side portion being attached rotatably to the base frame and the other long side portion being adapted to move in response to movements of a cam portion interlocked with a rotational reversing motion of said ice making tray.

2. A stored ice detecting device in an ice making apparatus according to claim 1, the ice making apparatus comprising an ice making tray disposed above said ice bank and adapted to be turned over from an upward ice making state to release ice and then turn back, a water supply passage for supplying water to said ice making tray, and a freeze storing chamber which incorporates said ice making tray therein.

* * * * *